US005201846A

United States Patent [19]

Sweeney

[11] Patent Number: 5,201,846

[45] Date of Patent: Apr. 13, 1993

[54] LOW-PRESSURE TURBINE HEAT SHIELD

[75] Inventor: Derek J. Sweeney, Dublin, Ireland

[73] Assignee: General Electric Company, Cincinnati, Ohio

[21] Appl. No.: 799,799

[22] Filed: Nov. 29, 1991

[51] Int. Cl.[5] ..... B63H 1/14

[52] U.S. Cl. ..... 415/173.6; 415/174.2; 415/178; 415/170.1; 415/177

[58] Field of Search ..... 415/173.6, 173.7, 170.1, 415/174.1, 174.2, 177, 178

[56] References Cited

U.S. PATENT DOCUMENTS

| | | | |
|---|---|---|---|
| 3,295,824 | 1/1967 | Woodwell et al. | 415/178 |
| 3,644,057 | 2/1972 | Steinbarger | 415/218 |
| 3,730,640 | 5/1973 | Rice et al. | 415/117 |
| 4,023,919 | 5/1977 | Patterson | 415/178 |
| 4,053,254 | 10/1977 | Chaplin et al. | 415/178 |
| 4,084,919 | 4/1978 | Morris, Jr. et al. | 415/173.7 |
| 4,257,222 | 3/1981 | Schwartz | 415/178 |
| 4,303,371 | 12/1981 | Eckert | 415/116 |
| 4,512,712 | 4/1985 | Baran, Jr. | 415/178 |
| 4,553,901 | 11/1985 | Laurello | 415/173.7 |
| 4,925,365 | 5/1990 | Crozet et al. | 415/173.6 |

FOREIGN PATENT DOCUMENTS

| | | | |
|---|---|---|---|
| 2169356 | 7/1986 | United Kingdom | 415/177 |

*Primary Examiner*—Thomas E. Denion

*Attorney, Agent, or Firm*—Jerome C. Squillaro; John R. Rafter

[57] ABSTRACT

A turbine for an axial flow gas turbine engine has a heat shield arranged in an annular space between the outer casing and an array of butted nozzle segments. The heat shield is made of a material which expands when subjected to the high temperatures generated inside said turbine during operation. A mechanism is provided for blocking rotation about the axial axis and axial displacement in an aft direction of the heat shield, while not blocking radial expansion of the heat shield. The outer casing and heat shield are dimensioned and configured so that after thermal expansion the heat shield and outer casing contact to form a gastight chamber therebetween, whereas prior to thermal expansion the heat shield and outer casing do not form a gastight chamber therebetween. The heat shield is a sheet metal ring.

17 Claims, 3 Drawing Sheets

LOW-PRESSURE TURBINE HEAT SHIELD

FIELD OF THE INVENTION

This invention relates generally to the stator stages in a low-pressure turbine in a gas turbine engine. Specifically, the invention relates to an improved mechanism for thermally isolating the outer casing surrounding a stator stage from hot gas leakage into the space between the casing and nozzle segments and from heat radiated by the nozzle segments.

BACKGROUND OF THE INVENTION

In a gas turbine aircraft engine air enters at the engine inlet and flows from there into the compressor. Compressed air flows to the combustor where it is mixed with injected fuel and the fuel-air mixture is ignited. The hot combustion gases flow through the turbine. The turbine extracts energy from the hot gases, converting it to power to drive the compressor and any mechanical load connected to the drive. These hot gases produce temperature differentials that cause plastic deformation in the components exposed thereto.

The turbine consists of a plurality of stages. Each stage is comprised of a rotating multi-bladed rotor and a nonrotating multi-vane stator. The blades of the rotor are circumferentially distributed on a disk for rotation therewith about the disk axis. The stator is formed by a plurality of nozzle segments which are butted end to end to form a complete ring. Each nozzle segment comprises a plurality of generally radially disposed vanes supported between inner and outer platforms. Each vane and blade is of airfoil section.

The abutting outer platforms of the nozzle segments and the abutting outer platforms of the rotor blades collectively define a radially inwardly facing wall of an annular gas flow passageway through the engine, while the abutting inner platforms of the nozzle segments and the abutting inner platforms of the rotor blades collectively define a radially outwardly facing wall of the annular gas flow passageway. The airfoils of the rotor blades and nozzle guide vanes extend radially into the passageway to interact aerodynamically with the gas flow therethrough.

During operation of the gas turbine engine, it is desirable to minimize thermally induced plastic deformation of the outer casing. This can be accomplished by isolating the outer casing from the heat produced by the hot gases flowing through the turbine.

One technique for thermally isolating a portion of the outer casing of a turbine which surrounds a stator stage is disclosed in U.S. Pat. No. 3,644,057 to Steinbarger. According to this teaching, a heat shield encircles the outer shroud ring. The heat shield is inserted in a pair of grooves formed between the casing and outer shroud ring, which grooves constrain the ends of the heat shield against radial and axial expansion. This arrangement has the disadvantages that the heat shield will undergo plastic deformation when heated and is difficult to install in the turbine.

In U.S. Pat. No. 3,730,640 to Rice et al., a ring having heat shielding properties has a portion arranged between the outer shroud of a row of guide vanes and the outer casing. At one end the ring has a radial flange bolted to one flange on the casing and at the other end the ring has a cylindrical flange, the radially outwardly facing surface of which abuts another flange on the casing. This arrangement is disadvantageous because the ring is constrained against both axial and radial displacement by the casing flanges at two axial positions, giving rise to plastic deformation during heating.

SUMMARY OF THE INVENTION

An object of the present invention is to improve upon the prior art mechanisms for minimizing the temperature of the turbine outer casing. In particular, it is an object of the invention to provide a mechanism which isolates the outer casing from both heat radiated by the nozzle segments and the hot gases leaking into the space between the casing and the nozzle segments.

Another object of the invention is to provide a heat shield which undergoes minimal plastic deformation during expansion due to heating. In particular, the heat shield of the invention is able to freely expand radially and axially.

A further object is to provide a heat shield which is inexpensive to manufacture and easy to install inside the turbine.

These and other objects are realized in accordance with the invention by providing a heat shield in the form of a sheet metal ring having a rearmost substantially cylindrical first section of predetermined diameter, a substantially conical second section connected to the first section, a substantially cylindrical third section having a diameter less than the predetermined diameter and connected to the second section, and a folded-back fourth section connected to and radially outside of the third section. The sheet metal ring has a plurality of axial recesses circumferentially distributed along and extending from a rearward edge of the first section. Each axial recess terminates along an arc which lies in a radial plane. A plurality of axial stops are joined to the sheet metal ring, each stop being arranged inside a corresponding axial recess. Each axial stop has a rearwardly facing abutment surface which lies substantially in a radial plane.

In accordance with the invention, the heat shield is installed between the outer casing and the nozzle segments of a turbine. The axial recesses of the heat shield cooperate with anti-rotation devices which prevent rotation of the heat shield about the axial axis. Axial stops are joined to the heat shield, each axial stop having a radial abutment surface that slides radially against an opposing radial surface of the anti-rotation device during thermal expansion of the heat shield.

The heat shield does not bear against the casing when installed, but expands radially and axially when exposed to heat radiation and hot gases during operation. As the result of thermal expansion, both ends of the heat shield bear against respective portions of the casing to form a tight chamber therebetween. This gastight chamber prevents hot gases from impinging on the casing. Also the heat shield absorbs and reflects heat radiated by the nozzle segments.

BRIEF DESCRIPTION OF THE DRAWINGS

These and other advantages of the invention will be better understood when the detailed description of the preferred embodiment of the invention is read in conjunction with the drawings, wherein.

DETAILED DESCRIPTION OF THE PREFERRED EMBODIMENT

Figure 1:
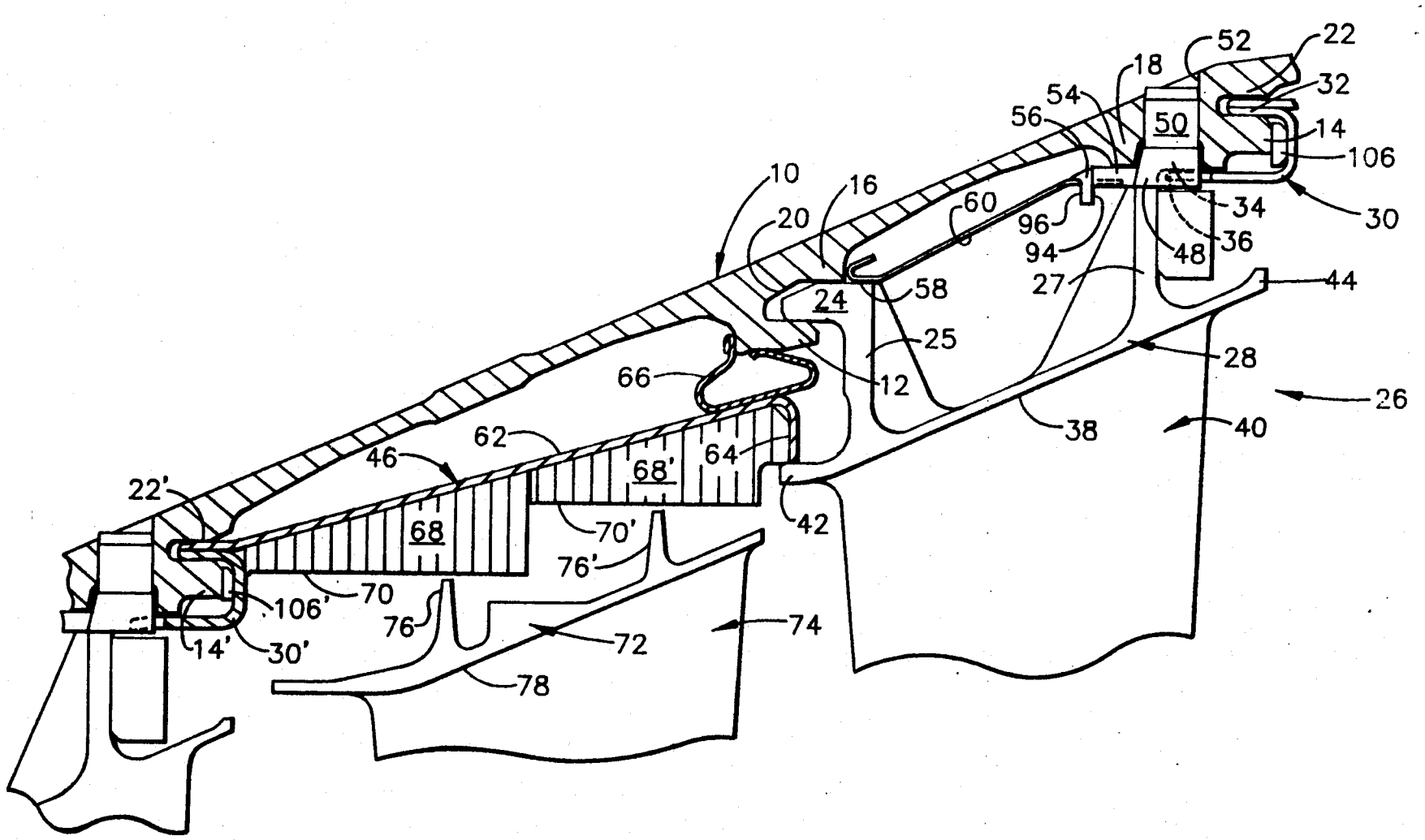
FIG. 1 is a cross-sectional view taken in a radial plane of a portion of an idle gas turbine engine incorporating a heat shield in accordance with the preferred embodiment of the invention.

In accordance with the preferred embodiment of the invention shown in FIG. 1, a low-pressure turbine of a gas turbine engine has an outer casing 10. Casing 10 has axially rearwardly directed annular flanges 12, 14 and 14' and bosses 16 and 18. Annular flange 12 and boss 16 partially define an annular groove 20 therebetween.

Annular groove 20 receives an annularly segmented flange 24 extending forward from a radially outwardly extending forward portion 25 of the outer platform of a nozzle segment generally indicated at 26. Annular groove 22 receives a leg 32 of each one of a plurality of annularly segmented C-clips 30.

Each C-clip 30 is connected to the corresponding downstream turbine shroud segment, for example, by brazing. The other leg 36 of each C-clip 30 has a radially outwardly directed surface which supports an annular flange 34 extending rearward from a radially outwardly extending rear portion 27 of the outer platform of the corresponding nozzle segment 26. Leg 36 has a recess which mates with an anti-rotation block 48. Anti-rotation block 48 is connected to anti-rotation pin 50, which in turn is securely mounted inside a bore 52 formed in outer casing 10. Twenty such anti-rotation pins are circumferentially distributed at equal intervals about the outer casing at the same axial position. This prevents rotation of the turbine shroud segment connected to C-clip 30.

In addition, an axial stop 106 is brazed to C-clip 30. Axial stop 106 has a radial surface which bears against an opposing radial surface of flange 14, thereby stopping forward axial displacement of the associated turbine shroud segment.

The radially innermost portion of the outer platforms of the arrayed nozzle segments 26 form an outer shroud 28 having a radially inwardly facing surface 38 which defines a downstream portion of an annular passageway for guiding the flow therethrough of hot gases from the combustor (not shown).

Each nozzle segment has a plurality of nozzle guide vanes 40 of airfoil section circumferentially distributed in a radial plane of the annular passageway and supported by the inner (not shown) and outer platforms. A plurality of nozzle segments are assembled into an annular array to form a stator stage. This stator stage redirects the hot gas flow from the upstream rotor so that it enters the downstream rotor at the desired angle.

Flange 34 of each nozzle segment 26 has a recess (not shown) which mates with an extension 54 of anti-rotation block 48. This mating of the recesses in the nozzle segments with the antirotation devices blocks rotation of the nozzle segments about the axial axis.

The outer shroud 28 has a forward tip 42 and a rearward tip 44. The forward tip 42 supports the tip of a radially inwardly directed annular flange 64 of a backing sheet 62 of a turbine shroud segment generally indicated at 46. A spring 66 arranged between flange 12 of outer casing 10 and backing sheet 62 urges the tip of flange 64 radially inwardly to bear against the radially outwardly directed annular surface of forward tip 42 of outer shroud 28. Spring 66 also resists axial displacement of the turbine shroud segment 46 in the aft direction. The structure and operation of the shroud segment 46 and spring 66 are disclosed in greater detail in copending U.S. patent application Ser. No. 07/799,528 for a Low Pressure Turbine Shroud (commonly assigned to the assignee of the present application), which disclosure is incorporated by reference herein.

The backing sheet 62 of each turbine shroud segment 46 has first and second members 68 and 68' made of honeycomb or similarly compliant material bonded or otherwise fastened to the radially inwardly facing surface thereof at adjacent axial positions. The honeycomb members have abradable working surfaces 70 and 70' respectively. The honeycomb material also discourages hot gas flow through any gap between flange 64 and forward tip 42 due to seam chording.

A plurality of such turbine shroud segments 46 are assembled into an annular array to form a turbine shroud which surrounds an array of abutting tip shrouds 72 on the rotor blades 74. The tip shrouds have radially inwardly facing surfaces 78 which define an upstream portion of the annular passageway for guiding the flow therethrough of hot gases from the combustor. The rearward edge of the tip shroud 72 of the rotor blade 74 is located such that hot gases flowing off of surface 78 will impinge on surface 38 of the outer shroud 28 of nozzle segment 26.

The tip shroud 72 of each rotor blade 74 has a pair of radially outwardly directed sealing fins 76 and 76' formed thereon which extend circumferentially. The sealing fins 76 and 76' of adjacent rotor blades have mutualy abutting side surfaces and respective circumferential edges which abut the working surfaces 70, 70' of the honeycomb material The working surfaces 70, 70' are deformed by the sealing fins during rotation of the associated rotor blade into an essentially zero tolerance fit with the sealing fins, thereby reducing the flow of hot gases radially outside of the annular array of tip shrouds 72.

Flange 64 of turbine shroud 46 is urged radially inward toward tip 42 of outer shroud 28 by spring 66, thereby resisting separation of the shrouds due to vibration. However, spring 66 cannot prevent the formation of a gap due to a difference in the respective radii of curvature of the arched edge of flange 64 and the radially outer surface of tip 42 caused by differential expansion, that is, seam chording. The result is that hot gases will leak into the space between the outer platform of nozzle segment 26 and outer casing 10 via either a path around flange 24 of the outer platform of the nozzle segment 26 or a path between the abutting faces of adjacent nozzle segments.

In addition, the outer platform of nozzle segment 26 is heated by the hot gases impinging on outer shroud 28. The outer platform of nozzle segment 26 then radiates heat radially outwardly toward the casing.

In the absence of means for isolating the casing from these effects, undesirable differential thermal expansion and plastic deformation of the casing can occur.

In accordance with the invention, this problem is remedied by arranging a heat shield 60 in the space between the outer platform of nozzle segment 26 and the outer casing 10. In accordance with the preferred embodiment of the invention, this heat shield is a ring made of HS188 sheet metal.

One function of heat shield 60 is to isolate the outer casing 10 from heat radiation from the outer platform of nozzle segment 26. Another function of heat shield 60 is to isolate outer casing 10 from the hot gases leaking into the space between nozzle segment 26 and outer casing 10. The structure of heat shield 60 and the manner in which it minimizes casing temperature will be described in detail hereinafter.

Figure 2:
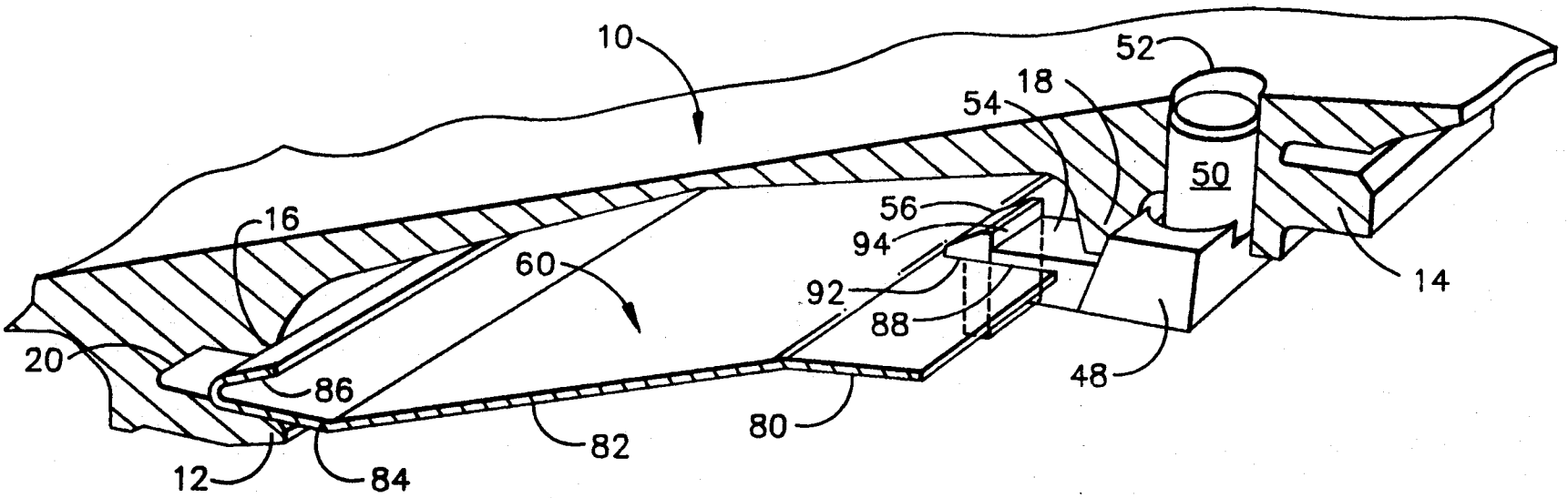
FIG. 2 is a sectional perspective view of the heat shield in accordance with the preferred embodiment of the invention.
Figure 3:
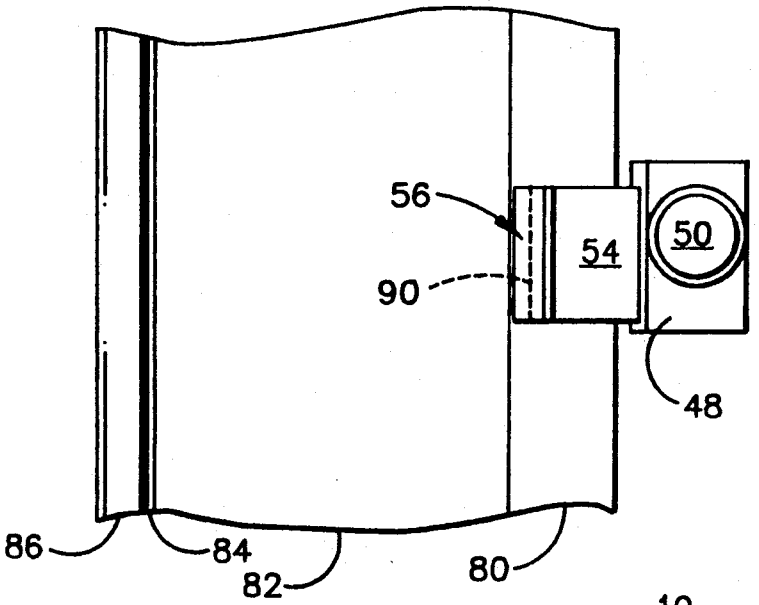
FIG. 3 is a partial top view of the heat shield in accordance with the preferred embodiment of the invention.

As shown in detail in FIGS. 2 and 3, heat shield 60 is a sheet metal ring formed with four sections connected in series: a rearmost substantially cylindrical section 80 having a predetermined diameter, a substantially conical section 82 connected to section 80, a substantially cylindrical section 84 having a diameter less than the predetermined diameter of section 80 and connected to section 82, and a folded-back section 86 connected to and radially outside of section 84.

Section 80 of heat shield 60 has a plurality of circumferentially distributed axial recesses 88 (see FIG. 2), twenty in number, which mate with corresponding ones of a plurality of axial extensions 54 of the respective anti-rotation blocks 50 to prevent rotation of the heat shield about the axial axis. The heat shield is sprung beneath the anti-rotation extensions during assembly. The axial termination 90 of recess 88 is indicated by a dashed line in FIG. 3.

An axial stop 56 is mounted inside each recess 88 of heat shield 60. Axial stop 56 has a forwardly facing surface 96 which abuts axial termination 90, side surfaces which abut the sides of recess 90 and a forwardly extending projection with an undersurface 92 that sits atop the radially outer surface of the heat shield 60 in the vicinity of axial termination 90 of recess 88. The axial stop is rigidly affixed to the heat shield by brazing or any other suitable method. Cooperation between the side surfaces of recess 88 and extension 54 of the anti-rotation block 34 effectively blocks rotation about the axial axis.

The rearwardly facing radial surface 94 of axial stop 56 abuts and slidably engages a forwardly facing radial surface of axial extension 54 of anti-rotation block 48. Because the shape of the cross section of extension 54 is constant in the radial direction and conforms to the shape of recess 88, section 80 of heat shield 60 is free to move radially outward as it expands due to heat from the combustion products. Heat shield 60 is also free to expand axially. However, extension 54 blocks axial displacement of the heat shield 60 in the aft direction. 60.

Figure 4:
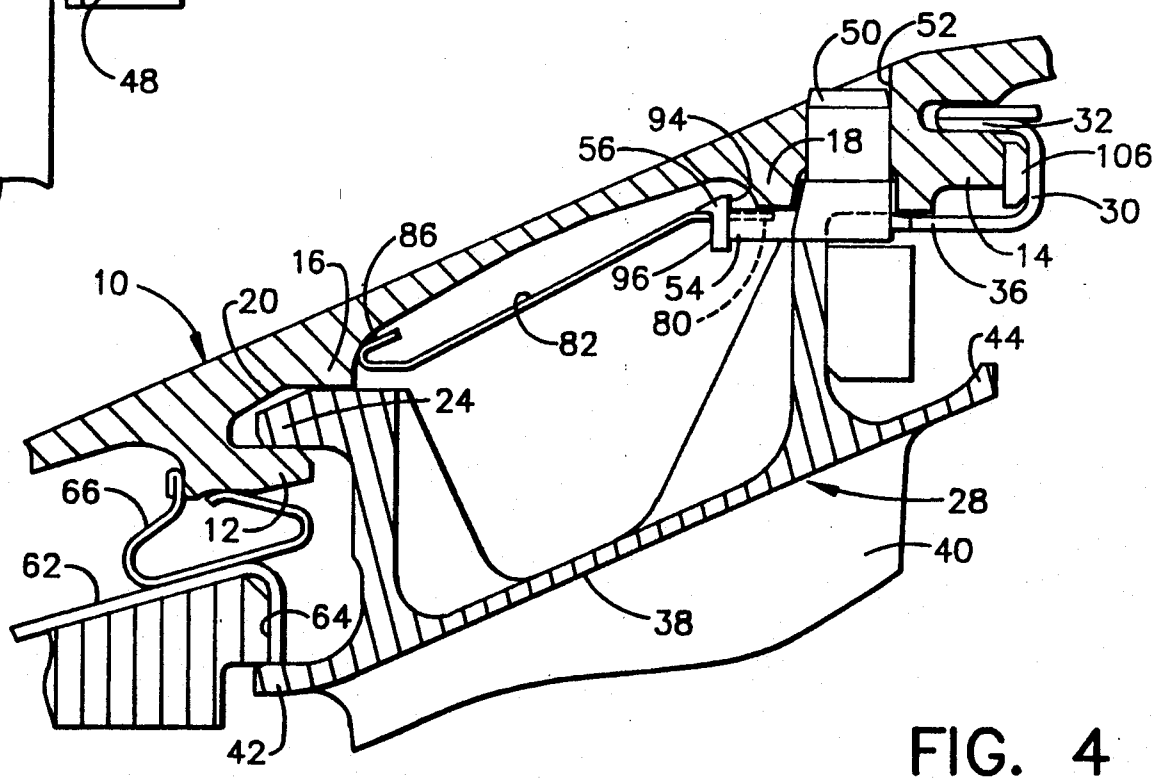
FIG. 4 is a cross-sectional view taken in a radial plane of a portion of an operating gas turbine engine incorporating a heat shield in accordance with the preferred embodiment of the invention.

FIGS. 1 and 4 respectively show the positions of heat shield 60 prior to and after thermal expansion. When the gas turbine engine is idle, section 84 of heat shield 60 is supported by the surface 58 of flange 24 of the outer platform of nozzle segment 26, as depicted in FIG. 1. During operation of the gas turbine engine, the heat shield 60 expands axially and radially as its temperature rises. Heat shield 60 is dimensioned and configured so that after radial and axial expansion, the curved portion of section 86 and the edge of section 80 will respectively bear tightly against bosses 16 and 18 of casing 10, thus forming a gastight chamber between heat shield 60 and casing 10.

Thus, heat shield 60 minimizes the casing temperature by preventing hot gases, which enter the space between the heat shield and the outer platform of nozzle segment 26, from entering the chamber between the heat shield and the casing. In addition, the heat shield absorbs and reflects heat radiated from the nozzle segments during operation.

The preferred embodiment has been described in detail hereinabove for the purpose of illustration only. It will be apparent to a practitioner of ordinary skill in the art of gas turbine engines that various modifications could be made to the above-described structure without departing from the spirit and scope of the invention as defined in the claims set forth hereinafter.

What is claimed is:

1. A heat shield for incorporation in a turbine of a gas turbine engine comprising:

a sheet metal ring having four sections connected in series as follows: a rearmost substantially cylindrical first section having a predetermined diameter, a substantially conical second section connected to said first section, a substantially cylindrical third section having a diameter less than the predetermined diameter of said first section and connected to said second section, and a folded-back fourth section connected to and radially outside of said third section.

a plurality of axial recesses circumferentially distributed along and extending from a rearward edge of said first section, wherein each of said axial recesses terminates along a corresponding arc of a circle, and a plurality of axial stops joined to said sheet metal ring, said axial stops being respectively arranged with a portion thereof disposed inside a corresponding axial recess, and each of said axial stops having rearwardly facing abutment surface which lies substantially in a radial plane.

2. A turbine for a gas turbine engine having an inlet, an outlet and an annular passageway for gas flow from said inlet to said outlet, comprising:

an outer casing surrounding said annular passageway and having an annular cavity situated between first and second annular projections, said first annular projection being located at a first axial position and said second annular projection being located at a second axial position downstream of said first axial position;

a plurality of nozzle segments circumferentially arranged end to end inside said outer casing to form a stator stage, each of said nozzle segments comprising an outer platform having a first portion which forms a part of said annular passageway, a second portion which is operatively supported by said outer casing at a point upstream of said cavity and a third portion which is operatively supported by said outer casing at a point downstream of said cavity, said outer platform and said outer casing defining a space therebetween that comprises said annular cavity; and an annular heat shield arranged inside said space, said heat shield being dimensioned and disposed so that after thermal expansion due to the heat from hot gases flowing through said turbine, a first portion of said heat shield abuts said first annular projection substantially contiguously along a circumference and a second portion of said heat shield abuts said second annular projection substantially contiguously along a circumference for forming a gas tight chamber between said shield and said outer casing.

3. A turbine as defined in claim 2, wherein said heat shield comprises a sheet metal ring.

4. A turbine as defined in claim 3, further comprising a plurality of anti-rotation means circumferentially distributed at regular intervals along and secured to said outer casing, wherein said sheet metal ring has a plurality of axial recesses circumferentially distributed along a rearward edge, each of said axial recesses mating with a portion of a corresponding anti-rotation means.

5. The turbine as defined in claim 4, wherein said sheet metal ring comprises four sections connected in series as follows: a rearmost substantially cylindrical first section having a predetermined diameter, a substantially conical second section connected to said first section, a substantially cylindrical third section having a diameter less than the predetermined diameter of said first section and connected to said second section, and a folded-back fourth section connected to and radially outside of said third section.

6. The turbine as defined in claim 5, wherein said sheet metal ring has a plurality of axial recesses circumferentially distributed along and extending from a rearward edge of said first section.

7. The turbine as defined in claim 6, wherein each of said axial recesses terminates along a corresponding arc of a circle.

8. The turbine as defined in claim 7, further comprising a plurality of axial stops joined to said sheet metal ring, said axial stops being respectively arranged with a portion thereof disposed inside a corresponding axial recess, and each of said axial stops having a rearwardly facing abutment surface which lies substantially in a radial plane.

9. The turbine as defined in claim 8, wherein said abutment surface of at least one of said axial stops slidably engages a radial stop surface of the corresponding one of said plurality of antirotation means during thermal expansion of said sheet metal ring in a radial direction.

10. A turbine for an axial flow gas turbine engine, comprising:

an outer casing symmetrically disposed relative to an axis of said turbine;

a plurality of nozzle segments circumferentially arranged end to end inside said outer casing to form a stator stage, each of said nozzle segments comprising an outer platform having a first portion which is operatively supported by said outer casing at an upstream position and a second portion which is operatively supported by said outer casing at a downstream position, said outer platforms and said outer casing defining an annular space therebetween;

an annular heat shield arranged inside said annular space, said heat shield being made of a material which expands when subjected to the high temperatures generated inside said turbine during operation of said gas turbine engine; and means for blocking rotation about said axial axis and axial displacement in an aft direction of said heat shield while not blocking radial expansion of said heat shield, wherein said outer casing and said heat shield are dimensioned and configured so that after thermal expansion due to the heat from hot gases flowing through said turbine, said heat shield and said outer casing contact to form a gastight chamber therebetween, whereas prior to said thermal expansion due to the heat from hot gases flowing through said turbine, said heat shield and said casing do not form a gastight chamber therebetween.

11. The turbine as defined in claim 10, wherein said outer casing has an annular cavity situated between first and second annular projections, and said heat shield has a first portion which abuts said first annular projection substantially contiguously along a circumference and a second portion which abuts said second annular projection substantially contiguously along a circumference.

12. The turbine as defined in claim 10, further comprising a plurality of anti-rotation means circumferentially distributed at regular intervals along and secured to said outer casing, wherein said heat shield has a plurality of axial recesses circumferentially distributed along a rearward edge, each of said axial recesses mating with a portion of a corresponding anti-rotation means.

13. The turbine as defined in claim 10, wherein said heat shield comprises a sheet metal ring.

14. The turbine as defined in claim 13, wherein said sheet metal ring comprises four sections connected in series as follows: a rearmost substantially cylindrical first section having a predetermined diameter, a substantially conical second section connected to said first section, a substantially cylindrical third section having a diameter less than the predetermined diameter of said first section and connected to said second section, and a folded-back fourth section connected to and radially outside of said third section.

15. The turbine as defined in claim 14, wherein said sheet metal ring has a plurality of axial recesses circumferentially distributed along and extending from a rearward edge of said first section.

16. The turbine as defined in claim 12, further comprising a plurality of axial stops joined to said heat shield, said axial stops being respectively arranged with a portion thereof disposed inside a corresponding axial recess, and each of said axial stops having a rearwardly facing abutment surface which lies substantially in a radial plane.

17. The turbine as defined in claim 16, wherein said abutment surface of at least one of said axial stops slidably engages a radial stop surface of the corresponding one of said plurality of antirotation means during thermal expansion of said heat shield in a radial direction.

* * * * *